United States Patent [19]

Tuck

[11] 4,145,635

[45] Mar. 20, 1979

[54] ELECTRON EMITTER WITH FOCUSSING ARRANGEMENT

[75] Inventor: Richard A. Tuck, Slough, England

[73] Assignee: E M I Varian Limited, Hayes, England

[21] Appl. No.: 847,857

[22] Filed: Nov. 2, 1977

[30] Foreign Application Priority Data

Nov. 4, 1976 [GB] United Kingdom ..... 45835/76

[51] Int. Cl.[2] ..... H01J 23/08

[52] U.S. Cl. ..... 315/5.39; 313/299; 313/309; 313/336

[58] Field of Search ..... 313/336, 309, 351, 348, 313/299; 315/5.39

[56] References Cited

U.S. PATENT DOCUMENTS 3,921,022 11/1975 Levine ..... 313/336 X 3,921,027 11/1975 Shelton et al. ..... 315/5.39

*Primary Examiner*—Eugene R. LaRoche

*Attorney, Agent, or Firm*—Fleit & Jacobson

[57] ABSTRACT

An electron emitter comprises field emitter zones formed by projections of field emissive material separated by regions which are not field emissive. An extractor electrode for applying an electric field to the projections and a focus electrode have openings aligned with the emitter zones and material particles aligned with the non-emissive regions. The electrodes form, when suitably energised electron focussing fields to focus electrons emitted from the zones.

10 Claims, 4 Drawing Figures

ELECTRON EMITTER WITH FOCUSSING ARRANGEMENT

This invention relates to an electron emitter.

Electron emitters are used as sources of electrons for electron discharge devices such as Klystron tubes and microwave tubes and in many applications an electron emitter which does not need to be heated to emit electrons is desirable. A field emitter in which electron emission from a surface of a field emission material is produced by an electron extraction electric field applied to that surface is known. However, such an emitter emits electrons over a large spread of directions. Furthermore, in order to apply the field an electrode arrangement is placed close to the surface. However, the arrangement intercepts electrons and is heated by them, which is undesirable.

It is an object of the invention to provide an electric field operated electron emitter, in which the direction of emission of electrons is controlled and in which heating by electron impact of the electrode arrangement for applying the extraction field is reduced.

According to the invention there is provided an electron emitter including:

a body of material which has a plurality of projections forming field emitter zones, which zones are separated by regions having no substantial projections and are thus not field emissive;

a foraminous (as herein defined) extractor electrode arrangement adjacent the body for receiving an extractor potential to apply an electron extraction field to the projections to draw electrons from the projections; and a foraminous focus electrode arrangement for receiving a further potential and positioned on that side of the extractor arrangement remote from the body;

means for applying the potentials to the electrode arrangements;

the potential applying means being so arranged and the electrode arrangements being so positioned relative to one another and to the zones, that the electrode arrangements electrically interact to form a plurality of electric focussing fields to cause electrons drawn from respective ones of the zones to converge onto predetermined paths, each zone being aligned with corresponding openings in both the electrode arrangements and each said region being aligned with corresponding material portions of the electrode arrangements.

By 'foraminous' electrode arrangement, is meant an electrode arrangement having a plurality of openings like a grid or mesh.

Each zone comprises at least one projection and in one embodiment of the invention each zone comprises an array of projections.

For better understanding of the invention reference will now be made, by way of example, to the accompanying drawings, of which:

It is known that an electric field can produce electron emission from a body of directionally solidified eutectic particularly when such a body has a surface having projections such as fibres. One example (J. App. Phy. Vol 46, p. 1841-3) uses a unidirectionally solidified oxide-metal composite with a uranium oxide matrix containing tungsten electron emitter fibres less than 1 microns in diameter. The matrix is etched to produce projecting fibres. Such an example provided up to several hundred mA/sq cm of emission with an electrode spaced about 0.5 mm from the surface maintained at 3 to 12KV, i.e. a field of between 6 and 24 KV/mm. However, this emission was not directed, being merely produced in a diode structure formed by the emitter (cathode) and an electrode (anode).

Figure 1:
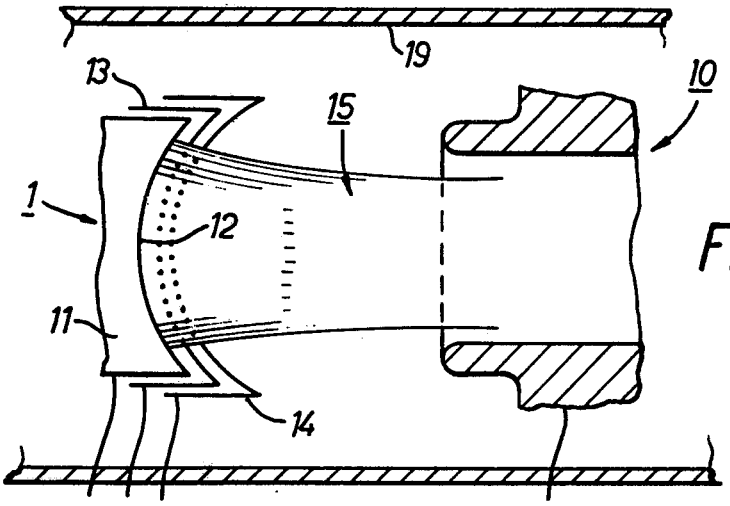
FIG. 1 shows field emitter according to the invention in an electron discharge device.

For an electron emitter to be useful in electron discharge devices, particularly linear beam microwave devices such as klystrons, the emission must be in a form that can be directed e.g. as a convergent beam. FIG. 1 shows an emitter construction by which a directed beam can be produced, together with an associated anode.

In FIG. 1 reference 1 indicates an emitter having a cathode of a body of directionally solidified eutectic 11, e.g. as described above, having a concave surface 12 forming a large area field emitter. The surface has projecting fibres, e.g. of tungsten. A first electrode 13 in the form of a grid with a mesh of some 0.5 mm pitch is supported to be adjacent the surface 12 and uniformly spaced some hundredths of millimeters from the surface 12. A second electrode 14 in the form of a similar grid is supported in front of the first electrode. The grids are uniformly spaced some hundredths of millimeters apart and therefore curved to be substantially parallel to one another. The meshes of the grids are arranged to be substantially coincident, firstly to avoid undue obstruction of the electrons emitted from the cathode 11 and secondly to control the direction of emission as now described with reference to FIG. 2.

Figure 2:
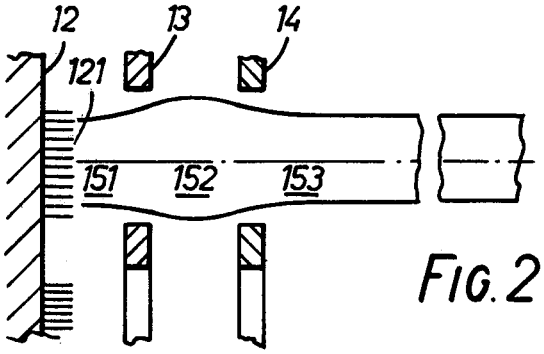
FIG. 2 shows an enlarged view of part of the emitter of FIG. 1.

In operation of an evacuated tube having an envelope 19 and including the arrangement of FIG. 1 the anode 10 is maintained at earth potential, and the cathode 11 at between −10KV and −40KV. Electrode 13 is maintained at between +1KV and +3KV with respect to the cathode when emission is required and electrode 14 at approximately the potential of the cathode. To prevent emission, electrode 13 can be set at cathode potential or negative with respect to the cathode. Electrodes emitted from surface 12 are directed by the cathode/-first grid potential gradient to pass through the grid plane. Those electrons entering the first electrode mesh apertures would, in the absence of the second grid, diverge to form a diffuse flood of electrons without a distinct direction. The first grid/second grid potential gradient and aligned mesh structure produces an electric field of Einzel lens form which maintains the electrons in parallel beams respectively in directions generally perpendicular to the surface 12 so that the directions are generally convergent as a result of the concavity of surface 12. The overall anode/cathode potential gradient then directs the convergent electrons into a generally linear beam 15. The overall effect is similar to that of a Pierce gun. FIG. 2 shows the electron paths in one mesh element of the grid electrodes. FIG. 2 also shows the micron-sized fibres, 121, projecting from surface 12. References 151, 152, 153 show the divergent, convergent and parallel portions of the electron paths to beam 15.

FIG. 2 also shows the distribution of the fibres 121 on the surface 12. The fibres are present only where emitted electrons will pass through the grid meshes and not present where emitted electrons would impinge on the mesh webs. In this way the heating of the grid by the incident electrons, which could have a power of some hundreds of watts, is greatly reduced if not eliminated.

Figure 3:
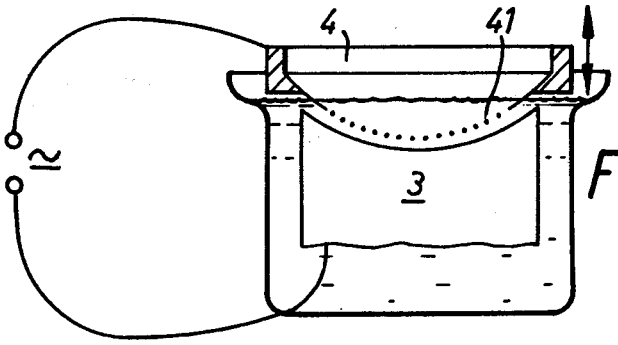
FIG. 3 shows one method of manufacture of the cathode of an emitter as shown in FIG. 1 and FIG. 2.

A suitable technique for producing such a fibre distribution is shown in FIG. 3. A body of eutectic material from which a cathode such as 12 in FIG. 1 is to be formed is indicated at 3. Adjacent the concave surface 31 a spark erosion electrode 4 having an apertured portion 41 conforming to the mesh webs of a grid electrode such as 13 is positioned. The erosion electrode and cathode body are placed in an oil bath for spark erosion in known manner. The erosion process is controlled to remove projections from the areas corresponding to the mesh webs leaving the projections corresponding to the mesh apertures. Thus the cathode will emit mainly where the projections remain, reducing the heating of the electrode grids in operation, saving power and reducing heat dissipation problems.

Clearly other techniques of selective removal of projections are possible, e.g. electro-chemical machining, etching and photoresist or even glow discharge machining of a complete emitter with the grids in place. Also other techniques for producing the large area field emitting arrays may be used, e.g. assembling fibres by winding techniques analogous to those used for carbon fibres. The mesh forms required for the electrode grids may be produced and positioned by techniques similar to those used for thermonic grid emitters. Other techniques of forming the regions where electrons are less easily emitted are possible, e.g. removing matrix material only where the projections are required, leaving baulks of matrix to define the region.

A field emitter according to the invention can be built using thin-film techniques resulting in an integral construction of field emitter body and extractor and forms electrodes 13 and 14, the electrodes being separated by a layer of dielectric material.

The emitter comprises a silicon substrate on which is a silicon dioxide insulating layer on which is a molybdenum film for acting as the extractor electrode. The film and insulating layer have many aligned apertures through them. In each aperture is a molybdenum cone which acts as a field emitter, the base of which is supported by the silicon substrate. A technique for making such a structure is described by C. A. Spindt, I. Brodie, L. Humphrey and E. R. Westerberg in an article entitled "Physical Properties of Thin-film Field Emission Cathodes with Molybdenum Cones" in Journal of Applied Physics, Vol. 47, No. 12, December 1976. In accordance with one embodiment of the present invention, a layer of insulative material is placed on the molybdenum film, the layer having apertures aligned with the apertures in the film, and a focus electrode film is placed on the insulative layer, again having apertures aligned with the apertures in the other film and in the insulative layers. The electrode films act, when suitably energised, to form Einzel lenses aligned with the cones to direct electrons emitted from the cones.

Emitters as described above are particularly suitable for devices where a rapid start-up is required as well as for steady state operation. Such devices include klystrons, travelling wave tubes, and cathode ray tubes, and perhaps magnetrons.

Figure 4:
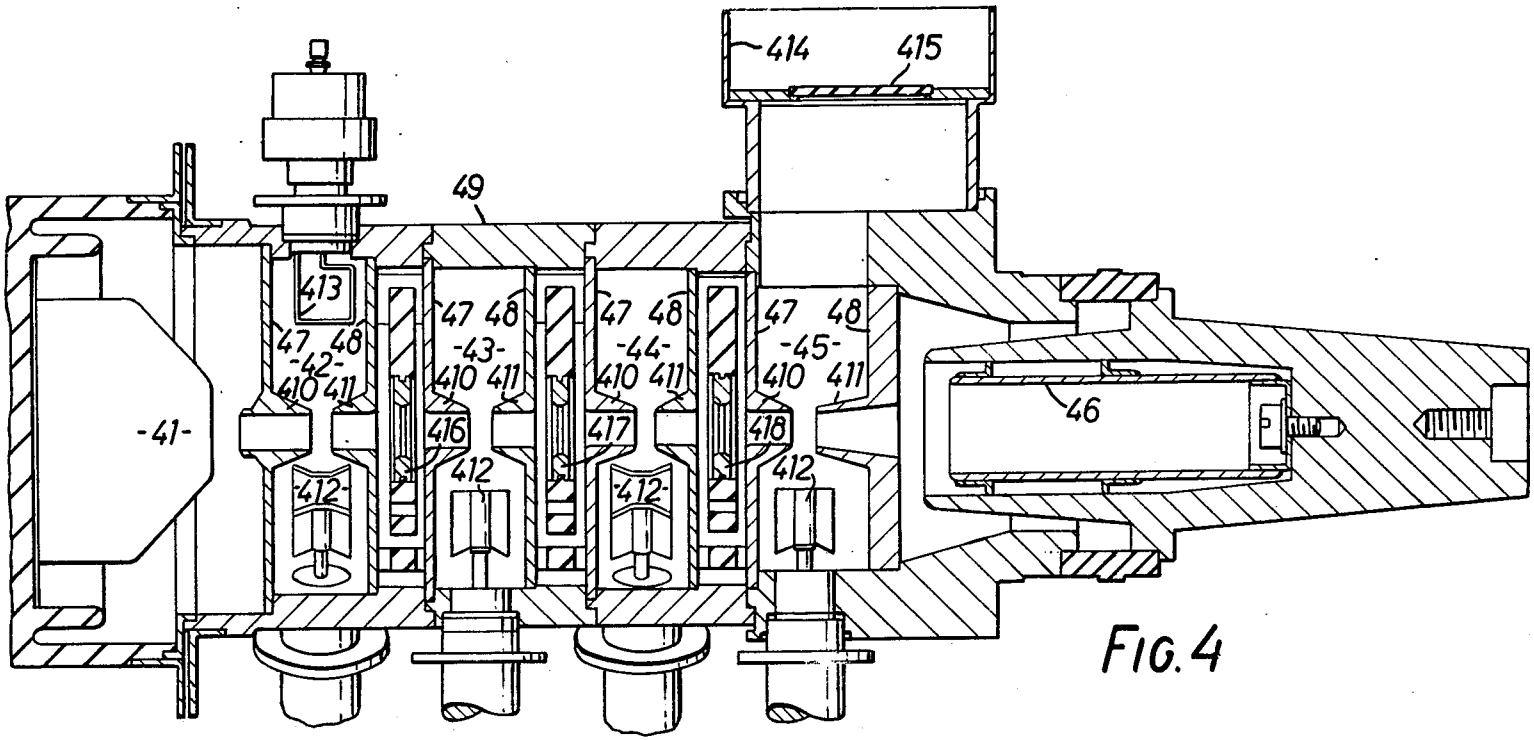
FIG. 4 is an axial cross-section of a klystron tube incorporating an emitter as shown in FIGS. 1 and 2.

For example, the above described emitter could be used in place of a thermonic emitter in a klystron tube as described in our British patent specification No. 1,161,877. FIG. 4 of the accompanying drawings is a longitudinal sectional view of that klystron tube. The klystron tube comprises an electron gun 41, including a field emitter as described hereinbefore, four resonant cavities 42, 43, 44 and 45 and a collector electrode 46 arranged in that order along the axis of the klystron. Electrostatic focussing electrodes 416, 417 and 418 are provided between each pair of cavities. Each of the cavities is formed by part of the copper envelope of the klystron, the transverse walls being denoted by reference 49. The walls 47 and 48 are formed with drift tubes 410 and 411 in known manner having control apertures which are coaxial. All the cavities have plungers 412 which can be moved radially within the cavities for the purpose of tuning. The cavity 42 is the input cavity and high frequency signals can be fed to it by way of a coupling loop 413. The cavity 45 is the output cavity and is coupled to an output waveguide 414 through a dielectric window 415.

What I claim is:

1. An electron emitter including:

a body of material which has a plurality of projections forming field emitter zones, which zones are separated by regions having no substantial projections and are thus not field emissive;

a foraminous extractor electrode arrangement adjacent the body for receiving an extractor potential to apply an electron extraction field to the projections to draw electrons from the projections; and a foraminous focus electrode arrangement for receiving a further potential and positioned on that side of the extractor arrangement remote from the body;

means for applying the potentials to the electrode arrangements;

the potential applying means being so arranged and the electrode arrangements being so positioned relative to one another and to the zones, that the electrode arrangements electrically interact to form a plurality of electric focussing fields to cause electrons drawn from respective ones of the zones to converge onto predetermined paths, each zone being aligned with corresponding openings in both the electrode arrangements and each said region being aligned with corresponding material portions of the electrode arrangements.

2. An emitter according to claim 1, wherein each zone comprises at least one projection.

3. An emitter according to claim 1, wherein each zone comprises an array of projections projecting from the surface of the body.

4. An emitter according to claim 3, wherein the body of material comprises eutectic material and the projections are aligned monocrystalline fibres.

5. An emitter according to claim 4, wherein the said surface is concave and the electrode arrangements have at least portions parallel to said surface.

6. An emitter according to claim 1, wherein the electrode arrangements comprise aligned meshes.

7. An emitter according to claim 1, wherein the said zones lie on a concave surface to tend to focus the emitted electrons.

8. An electric discharge tube comprising an electron emitter according to claim 1.

9. A tube according to claim 8, which is a linear beam tube.

10. A tube according to claim 9, which is a klystron.

* * * * *